US010632747B2

(12) United States Patent
Lebron et al.

(10) Patent No.: US 10,632,747 B2
(45) Date of Patent: Apr. 28, 2020

(54) FLUID EJECTION DEVICE

(71) Applicant: HEWLETT-PACKARD DEVELOPMENT COMPANY, L.P., Fort Collins, CO (US)

(72) Inventors: Hector J Lebron, San Diego, CA (US); Melinda M Valencia, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/312,371

(22) PCT Filed: Oct. 14, 2016

(86) PCT No.: PCT/US2016/057095
§ 371 (c)(1),
(2) Date: Dec. 21, 2018

(87) PCT Pub. No.: WO2018/071039
PCT Pub. Date: Apr. 19, 2018

(65) Prior Publication Data

US 2019/0224969 A1 Jul. 25, 2019

(51) Int. Cl.
*B41J 2/14* (2006.01)

(52) U.S. Cl.
CPC ..... *B41J 2/14016* (2013.01); *B41J 2/1433* (2013.01); *B41J 2002/14475* (2013.01)

(58) Field of Classification Search
CPC ..... B41J 2/14016; B41J 2/1433; B41J 2002/14475
See application file for complete search history.

(56) References Cited

U.S. PATENT DOCUMENTS

| | | | |
|---|---|---|---|
| 5,666,143 | A | 9/1997 | Burke et al. |
| 5,724,082 | A | 3/1998 | Moynihan |
| 5,734,399 | A | 3/1998 | Weber et al. |
| 6,007,188 | A | 12/1999 | MacLeod et al. |
| 6,244,694 | B1 | 6/2001 | Weber et al. |
| 6,260,957 | B1 | 7/2001 | Corley, Jr. et al. |
| 6,264,309 | B1 | 7/2001 | Sullivan |
| 6,557,974 | B1 | 5/2003 | Weber |
| 6,764,605 | B2 | 7/2004 | Donaldson et al. |
| 6,964,743 | B2 | 11/2005 | Min et al. |

(Continued)

FOREIGN PATENT DOCUMENTS

| | | |
|---|---|---|
| EP | 1447221 | 4/2004 |
| JP | 05261930 | 10/1993 |

(Continued)

OTHER PUBLICATIONS

IP.com search (Year: 2019).*

(Continued)

*Primary Examiner* — Lisa Solomon
(74) *Attorney, Agent, or Firm* — Dicke, Billig & Czaja, PLLC

(57) ABSTRACT

A fluid ejection device includes a fluid ejection chamber, a drop ejecting element communicated with the fluid ejection chamber, an orifice communicated with the fluid ejection chamber, a fluid passage between the fluid ejection chamber and the orifice, and a structure in the fluid passage between the fluid ejection chamber and the orifice.

15 Claims, 7 Drawing Sheets

(56) References Cited

U.S. PATENT DOCUMENTS

| | | | |
|---|---|---|---|
| 7,530,169 | B2 | 5/2009 | Bergstrom et al. |
| 7,549,225 | B2 | 6/2009 | Chen et al. |
| 7,807,079 | B2 | 10/2010 | Rausch et al. |
| 9,289,986 | B2 | 3/2016 | Mallinson et al. |
| 9,352,568 | B2 | 5/2016 | Rivas et al. |
| 2004/0004649 | A1 | 1/2004 | Bibl et al. |
| 2006/0000925 | A1 | 1/2006 | Maher et al. |
| 2009/0096839 | A1* | 4/2009 | Olbrich ..... B41J 2/1404 347/62 |
| 2011/0041335 | A1 | 2/2011 | Xie |
| 2011/0205303 | A1 | 8/2011 | Pan et al. |
| 2013/0187984 | A1 | 7/2013 | Feinn et al. |
| 2014/0160200 | A1 | 6/2014 | Kim |
| 2014/0333695 | A1 | 11/2014 | Amma et al. |
| 2015/0091982 | A1 | 4/2015 | Stolk et al. |
| 2015/0314601 | A1 | 11/2015 | Rivas |

FOREIGN PATENT DOCUMENTS

| | | | |
|---|---|---|---|
| KR | 20090081759 | | 7/2009 |
| WO | WO-2011146069 | A1 | 11/2011 |
| WO | WO-2013130039 | | 9/2013 |
| WO | WO-2016122528 | | 8/2016 |

OTHER PUBLICATIONS

Shin, D-Y., et al, Theoretical Investigation of the Influence of Nozzle Diameter Variation on the Fabrication of Thin Film Transistor Liquid Crystal Display Color Filters, Jun. 9, 2008, < http://scitation.aip.org/content/aip/journal/jap/103/11/10.1063/1.2936885 >.

* cited by examiner

FLUID EJECTION DEVICE

BACKGROUND

Fluid ejection devices, such as printheads in printing systems, may use thermal resistors or piezoelectric material membranes as actuators within fluidic chambers to eject fluid drops from nozzles.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1:
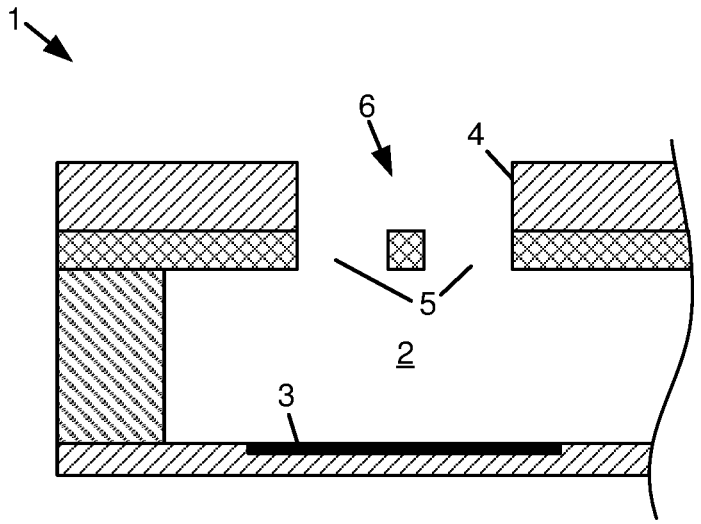
FIG. 1 is a schematic illustration of an example of a portion of a fluid ejection device.

As illustrated in the example of FIG. 1, the present disclosure provides a fluid ejection device 1 including a fluid ejection chamber 2, a drop ejecting element 3 communicated with the fluid ejection chamber, an orifice 4 communicated with the fluid ejection chamber, a fluid passage 5 between the fluid ejection chamber and the orifice, and a structure 6 in the fluid passage between the fluid ejection chamber and the orifice. In one implementation, the structure provides a particle-blocking feature or particle tolerant architecture (PTA) between the fluid ejection chamber and the orifice such the particle-blocking feature helps to prevent particles from entering the fluid ejection chamber through the orifice.

Figure 2A:
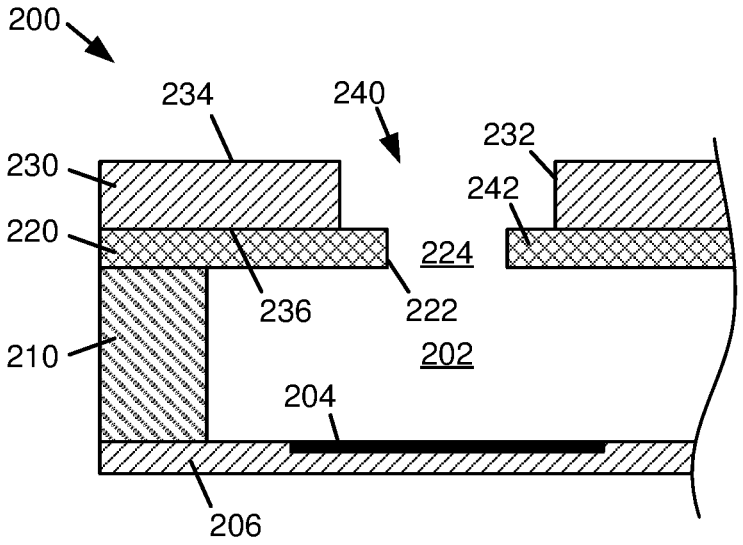
FIGS. 2A and 2B schematically illustrate an example of a portion of a fluid ejection device.
Figure 2B:
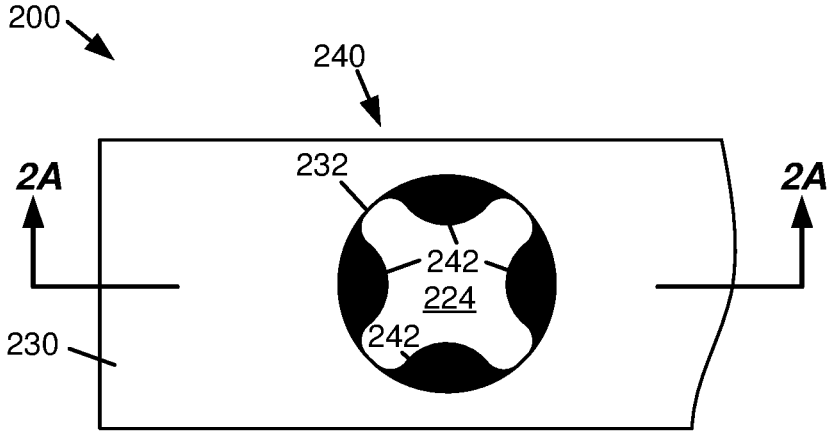

FIGS. 2A and 2B schematically illustrate an example of a portion of a fluid ejection device 200, with FIG. 2A representing a schematic cross-sectional view of an example of a portion of fluid ejection device 200, and FIG. 2B representing a schematic top view of an example of a portion of fluid ejection device 200. Fluid ejection device 200 includes a fluid ejection chamber 202 and a corresponding drop ejector or drop ejecting element 204 formed in, provided within, or communicated with fluid ejection chamber 202. In one example, fluid ejection chamber 202 and drop ejecting element 204 are formed on a substrate 206 which has a fluid feed slot (not shown) formed therein such that the fluid feed slot provides a supply of fluid to fluid ejection chamber 202 and drop ejecting element 204 ejects drops of the fluid. Substrate 206 may be formed, for example, of silicon, glass, or a stable polymer.

In one example, fluid ejection chamber 202 is formed in or defined by a barrier layer 210 provided on substrate 206, such that fluid ejection chamber 202 provides a "well" in barrier layer 210. Barrier layer 210 may be formed, for example, of a photoimageable epoxy resin, such as SU8.

In one example, an underlayer 220 and a nozzle plate or orifice layer 230 are formed or extended over barrier layer 210 such that a nozzle opening or orifice 232 formed in orifice layer 230 communicates with fluid ejection chamber 202 and an opening 222 formed in underlayer 220 communicates with fluid ejection chamber 202 and orifice 232. As such, opening 222 provides a fluid passage 224 between fluid ejection chamber 202 and orifice 232 through underlayer 220. Orifice 232 and opening 222 each, individually, may be of a circular, non-circular, or other shape.

Drop ejecting element 204 can be any device capable of ejecting drops of fluid through corresponding orifice 232. Examples of drop ejecting element 204 include a thermal resistor or a piezoelectric actuator. A thermal resistor, as an example of a drop ejecting element, may be formed on a surface of a substrate (e.g., substrate 206) and include a thin-film stack including an oxide layer, a metal layer, and a passivation layer such that, when activated, heat from the thermal resistor vaporizes fluid in fluid ejection chamber 202, thereby generating a bubble that ejects a drop of fluid through orifice 232. A piezoelectric actuator, as an example of a drop ejecting element, may include a piezoelectric material provided on a moveable membrane communicated with fluid ejection chamber 202 such that, when activated, the piezoelectric material causes deflection of the membrane relative to fluid ejection chamber 202, thereby generating a pressure pulse that ejects a drop of fluid through orifice 232.

In one example, fluid ejection device 200 includes a particle tolerant architecture (PTA) 240. Particle tolerant architecture 240 includes, for example, a feature or structure (including multiple features or multiple structures) formed in or provided within fluid passage 224 to impede or limit passage of certain particles through fluid passage 224. More specifically, particle tolerant architecture 240 constitutes an occlusion, restriction or obstruction in fluid passage 224 which varies or segments a cross-sectional area of fluid passage 224 and reduces an effective area of fluid passage 224 through which particles could pass, thereby providing fluid passage 224 with a reduced pass-through area (or areas).

In one example, particle tolerant architecture 240 forms a particle filtering or particle blocking feature which allows fluid to flow through fluid passage 224 and be ejected from fluid ejection chamber 202 through orifice 232 while preventing certain particles from entering fluid ejection chamber 202 through orifice 232. More specifically, particle tolerant architecture 240 allows fluid to be ejected through orifice 232 (in one direction) and prevents certain particles (e.g., dust, fibers, or other particles that may enter orifice 232) from passing through fluid passage 224 and into fluid ejection chamber 202 (in an opposite direction). For example, with fluid passage 224 having a pass-through area less than a pass-through area of orifice 232, particles that may be sized (i.e., small enough) to pass through orifice 232, but not sized (i.e., too big) to pass through fluid passage 224, may be prevented from passing through fluid passage 224 and into fluid ejection chamber 202. Such particles, if allowed to enter fluid ejection chamber 202, may affect a performance of fluid ejection device 200.

As illustrated in the example of FIG. 2A, particle tolerant architecture 240 is provided on an entry side of orifice 232 (i.e., upstream of a direction of fluid ejection from fluid ejection chamber 202 through orifice 232). More specifically, in one implementation, orifice layer 230 has a first side 234 (from which drops of fluid are ejected) and a second side 236 opposite first side 234 such that underlayer 220, as forming or including particle tolerant architecture 240, is disposed on second side 236 of orifice layer 230. Thus, particle tolerant architecture 240 is recessed relative to orifice 232 and, more specifically, recessed relative to first side 234 of orifice layer 230. As such, particle tolerant architecture 240 does not interfere with and is protected from maintenance operations (e.g., wiping of orifice layer 230 with a wiper) and other external interactions.

In one implementation, as illustrated in the example of FIGS. 2A and 2B, particle tolerant architecture 240 includes a lobe or multiple lobes 242 extended into fluid passage 224 from a side of fluid passage 224. In one example, particle tolerant architecture 240 includes four lobes 242 extended into fluid passage 224 from opposing sides of fluid passage 224 so as to vary a cross-sectional area of fluid passage 224. As such, lobes 242 form a restriction or obstruction in fluid passage 224 and reduce a pass-through area of fluid passage 224. More specifically, lobes 242 reduce an effective area of fluid passage 224 through which particles may pass. Although particle tolerant architecture 240 is illustrated as including four lobes 242, particle tolerant architecture 240 may include any number, as well as any size, shape, or configuration of lobes 242.

In one implementation, as illustrated in the example of FIG. 2A, lobes 242 of particle tolerant architecture 240 are formed by or as part of underlayer 220. As such, underlayer 220 provides or represents a particle tolerant layer (PTL) of fluid ejection device 200.

Figure 3A:
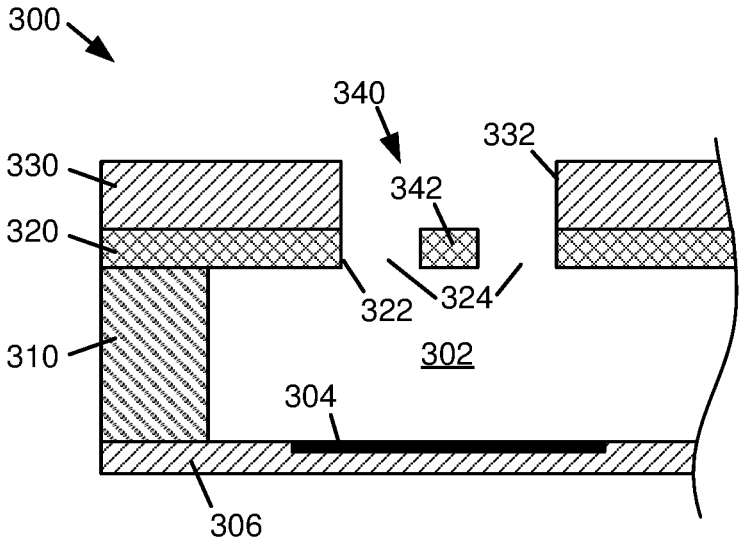
FIGS. 3A and 3B schematically illustrate an example of a portion of a fluid ejection device.
Figure 3B:
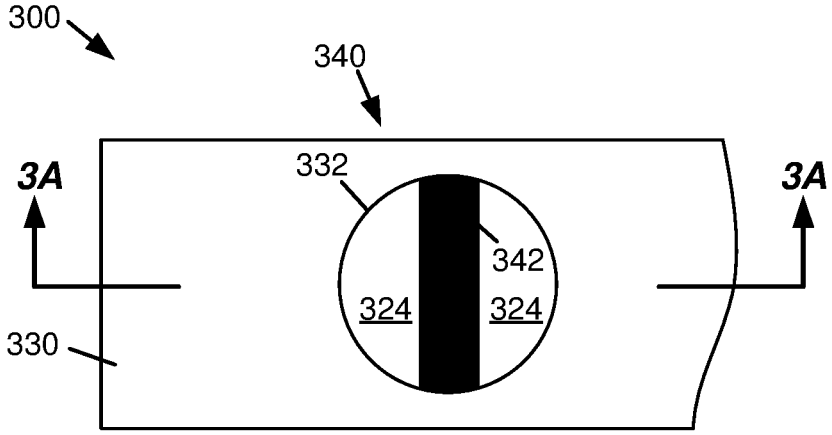

FIGS. 3A and 3B schematically illustrate an example of a portion of a fluid ejection device 300. Similar to fluid ejection device 200, fluid ejection device 300 includes a fluid ejection chamber 302 and a corresponding drop ejecting element 304 formed in, provided within, or communicated with fluid ejection chamber 302, with fluid ejection chamber 302 and drop ejecting element 304 formed on a substrate 306.

Similar to fluid ejection device 200, fluid ejection chamber 302 of fluid ejection device 300 is formed in or defined by a barrier layer 310 provided on substrate 306, and an underlayer 320 and a nozzle plate or orifice layer 330 are formed or extended over barrier layer 310 such that a nozzle opening or orifice 332 formed in orifice layer 330 communicates with fluid ejection chamber 302 and an opening 322 formed in underlayer 320 communicates with fluid ejection chamber 302 and orifice 332. As such, opening 322 provides a fluid passage 324 between fluid ejection chamber 302 and orifice 332 through underlayer 320. In addition, similar to fluid ejection device 200, fluid ejection device 300 includes a particle tolerant architecture (PTA) 340.

In one implementation, as illustrated in the example of FIGS. 3A and 3B, particle tolerant architecture 340 includes a beam or bar 342 extended into fluid passage 324 from a side of fluid passage 324. In one example, bar 342 extends across fluid passage 324 between opposite sides of fluid passage 324 so as to segment a cross-sectional area of fluid passage 324. As such, bar 342 forms a restriction or obstruction in fluid passage 324 and reduces a pass-through area of fluid passage 324. More specifically, bar 342 reduces an effective area of fluid passage 324 through which particles could pass. Particle tolerant architecture 340 may include any size, shape (including cross-sectional shape), or configuration of bar 342.

In one implementation, as illustrated in the example of FIG. 3A, bar 342 of particle tolerant architecture 340 is formed by or as part of underlayer 320. As such, underlayer 320 provides or represents a particle tolerant layer (PTL) of fluid ejection device 300.

Figure 4A:
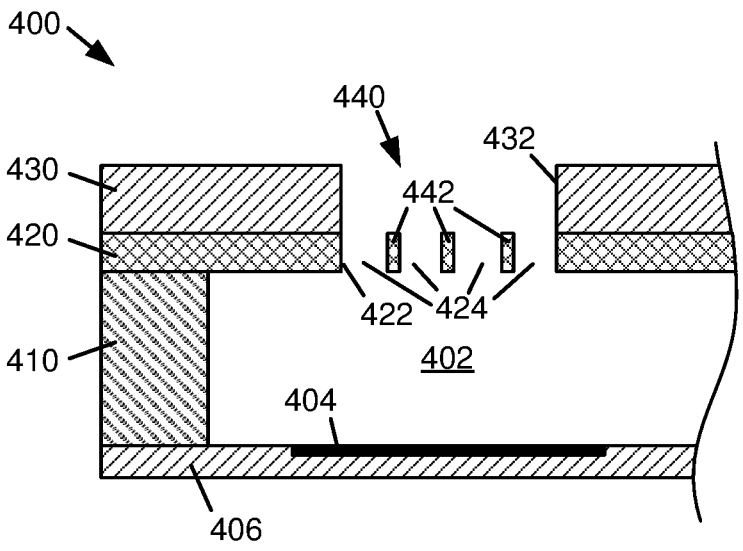
FIGS. 4A and 4B schematically illustrate an example of a portion of a fluid ejection device.
Figure 4B:
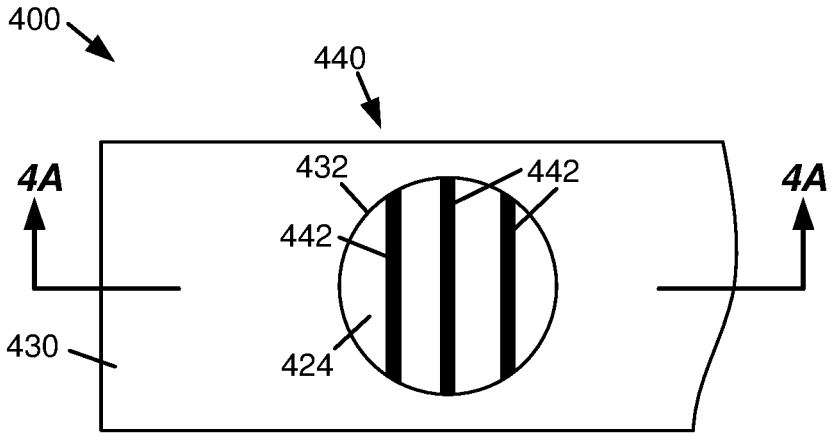

FIGS. 4A and 4B schematically illustrate an example of a portion of a fluid ejection device 400. Similar to fluid ejection device 200, fluid ejection device 400 includes a fluid ejection chamber 402 and a corresponding drop ejecting element 404 formed in, provided within, or communicated with fluid ejection chamber 402, with fluid ejection chamber 402 and drop ejecting element 404 formed on a substrate 406.

Similar to fluid ejection device 200, fluid ejection chamber 402 of fluid ejection device 400 is formed in or defined by a barrier layer 410 provided on substrate 406, and an underlayer 420 and a nozzle plate or orifice layer 430 are formed or extended over barrier layer 410 such that a nozzle opening or orifice 432 formed in orifice layer 430 communicates with fluid ejection chamber 402 and an opening 422 formed in underlayer 420 communicates with fluid ejection chamber 402 and orifice 432. As such, opening 422 provides a fluid passage 424 between fluid ejection chamber 402 and orifice 432 through underlayer 420. In addition, similar to fluid ejection device 200, fluid ejection device 400 includes a particle tolerant architecture (PTA) 440.

In one implementation, as illustrated in the example of FIGS. 4A and 4B, particle tolerant architecture 440 includes multiple beams or bars 442 extended into fluid passage 424 from a side of fluid passage 424. In one example, bars 442 extend and are spaced substantially parallel to each other across fluid passage 424 so as to segment a cross-sectional area of fluid passage 424 and provide a grate or grating across fluid passage 424. As such, bars 442 form a restriction or obstruction in fluid passage 424 and reduce a pass-through area of fluid passage 424. More specifically, bars 442 reduce an effective area of fluid passage 424 through which particles could pass. Although particle tolerant architecture 440 is illustrated as including three beams or bars 442, particle tolerant architecture 440 may include any number, as well as any size, shape (including cross-sectional shape), or configuration of beams or bars 442.

In one implementation, as illustrated in the example of FIG. 4A, bars 442 of particle tolerant architecture 440 are formed by or as part of underlayer 420. As such, underlayer 420 provides or represents a particle tolerant layer (PTL) of fluid ejection device 400.

Figure 5A:
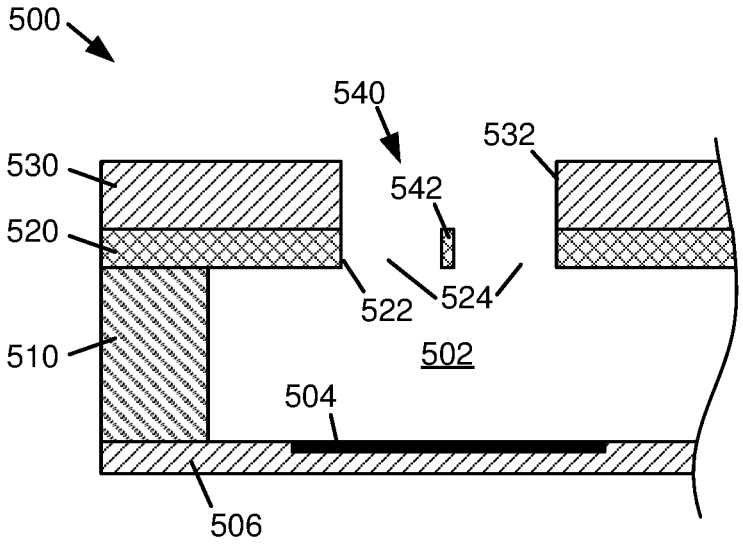
FIGS. 5A and 5B schematically illustrate an example of a portion of a fluid ejection device.
Figure 5B:
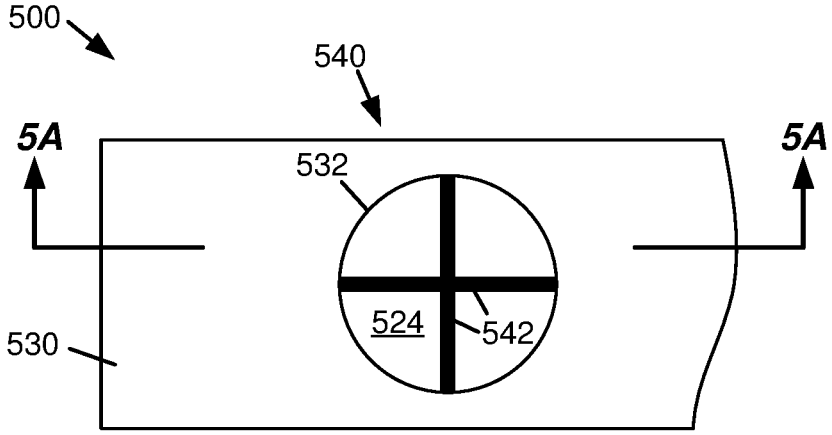

FIGS. 5A and 5B schematically illustrate an example of a portion of a fluid ejection device 500. Similar to fluid ejection device 200, fluid ejection device 500 includes a fluid ejection chamber 502 and a corresponding drop ejecting element 504 formed in, provided within, or communicated with fluid ejection chamber 502, with fluid ejection chamber 502 and drop ejecting element 504 formed on a substrate 506.

Similar to fluid ejection device 200, fluid ejection chamber 502 of fluid ejection device 500 is formed in or defined by a barrier layer 510 provided on substrate 506, and an underlayer 520 and a nozzle plate or orifice layer 530 are formed or extended over barrier layer 510 such that a nozzle opening or orifice 532 formed in orifice layer 530 communicates with fluid ejection chamber 502 and an opening 522 formed in underlayer 520 communicates with fluid ejection chamber 502 and orifice 532. As such, opening 522 provides a fluid passage 524 between fluid ejection chamber 502 and orifice 532 through underlayer 520. In addition, similar to fluid ejection device 200, fluid ejection device 500 includes a particle tolerant architecture (PTA) 540.

In one implementation, as illustrated in the example of FIGS. 5A and 5B, particle tolerant architecture 540 includes intersecting beams or bars 542 extended into fluid passage 524 from a side of fluid passage 524. In one example, intersecting bars 542 extend across fluid passage 524 between opposite sides of fluid passage 524 and are oriented substantially orthogonal to each other so as to provide a "cross" across fluid passage 524 and segment a cross-sectional area of fluid passage 524. As such, intersecting bars 542 form a restriction or obstruction in fluid passage 524 and reduce a pass-through area of fluid passage 524. More specifically, bars 542 reduce an effective area of fluid passage 524 though which particles could pass. Although particle tolerant architecture 540 is illustrated as including two intersecting beams or bars 542, particle tolerant architecture 540 may include any number, as well as any size, shape (including cross-sectional shape), or configuration of intersecting beams or bars 542.

In one implementation, as illustrated in the example of FIG. 5A, intersecting bars 542 of particle tolerant architecture 540 are formed by or as part of underlayer 520. As such, underlayer 520 provides or represents a particle tolerant layer (PTL) of fluid ejection device 500.

Figure 6A:
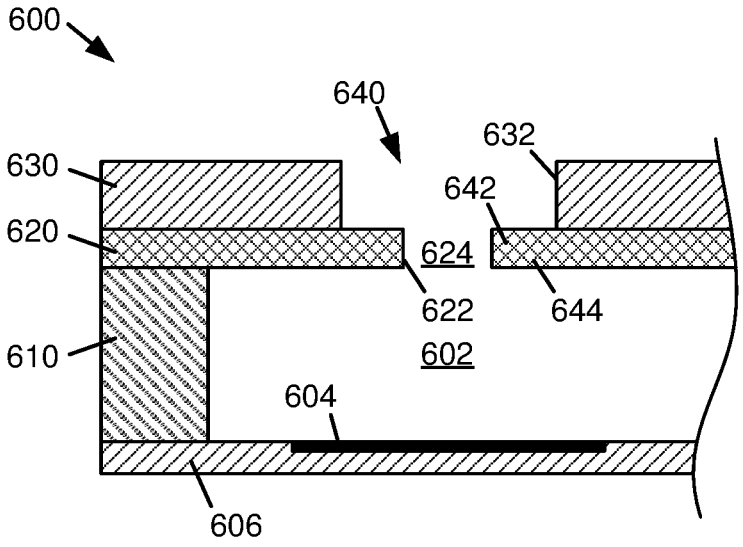
FIGS. 6A and 6B schematically illustrate an example of a portion of a fluid ejection device.
Figure 6B:
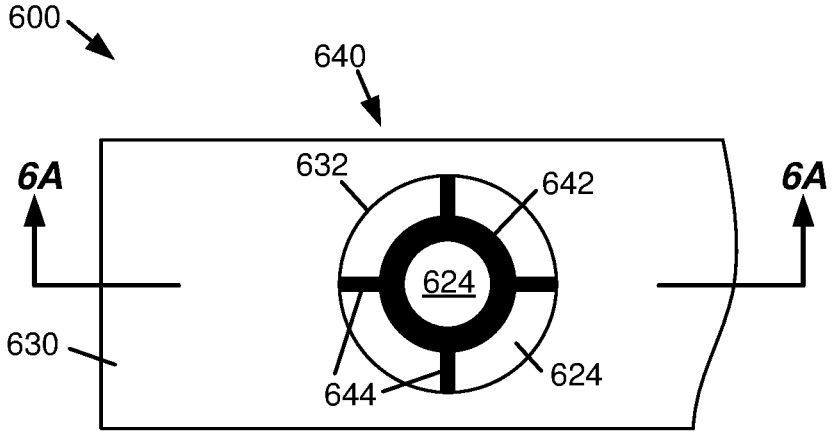

FIGS. 6A and 6B schematically illustrate an example of a portion of a fluid ejection device 600. Similar to fluid ejection device 200, fluid ejection device 600 includes a fluid ejection chamber 602 and a corresponding drop ejecting element 604 formed in, provided within, or communicated with fluid ejection chamber 602, with fluid ejection chamber 602 and drop ejecting element 604 formed on a substrate 606.

Similar to fluid ejection device 200, fluid ejection chamber 602 of fluid ejection device 600 is formed in or defined by a barrier layer 610 provided on substrate 606, and an underlayer 620 and a nozzle plate or orifice layer 630 are formed or extended over barrier layer 610 such that a nozzle opening or orifice 632 formed in orifice layer 630 communicates with fluid ejection chamber 602 and an opening 622 formed in underlayer 620 communicates with fluid ejection chamber 602 and orifice 632. As such, opening 622 provides a fluid passage 624 between fluid ejection chamber 602 and orifice 632 through underlayer 620. In addition, similar to fluid ejection device 200, fluid ejection device 600 includes a particle tolerant architecture (PTA) 640.

In one implementation, as illustrated in the example of FIGS. 6A and 6B, particle tolerant architecture 640 includes a ring 642 supported within fluid passage 624. In one example, ring 642 is supported by beams or bars 644 extended from sides of fluid passage 624 such that ring 642 is concentric to fluid passage 624 and segments a cross-sectional area of fluid passage 624. As such, ring 642 and bars 644 form a restriction or obstruction in fluid passage 624 and reduce a pass-through area of fluid passage 624. More specifically, ring 642 and bars 644 reduce an effective area of fluid passage 624 through which particles could pass. Although particle tolerant architecture 640 is illustrated as including four beams or bars 644 supporting ring 642, particle tolerant architecture 640 may include any number, as well as any size, shape (including cross-sectional shape), or configuration of beams or bars 644 and ring 642.

In one implementation, as illustrated in the example of FIG. 6A, ring 642 and bars 644 of particle tolerant architecture 640 are formed by or as part of underlayer 620. As such, underlayer 620 provides or represents a particle tolerant layer (PTL) of fluid ejection device 600.

In one implementation, fluid ejection device 200, 300, 400, 500, 600, as illustrated in the respective examples of FIGS. 2A and 2B, 3A and 3B, 4A and 4B, 5A and 5B, 6A and 6B, constitutes or forms part of a printhead for a printer, such as an inkjet or fluid jet printer, including, for example, a three-dimensional (3-D) printer.

In one example, a 3-D printer includes a printhead or fluid agent distributor which ejects drops of a fluid agent onto a layer or layers of a build material, whereby energy, such as heat, is applied to the layer or layers of build material such that the build material is fused or sintered. The build material may comprise a powder-based build material, where the powder-based build material may include wet and/or dry powder-based materials, particulate materials, and/or granular materials.

Figure 7:
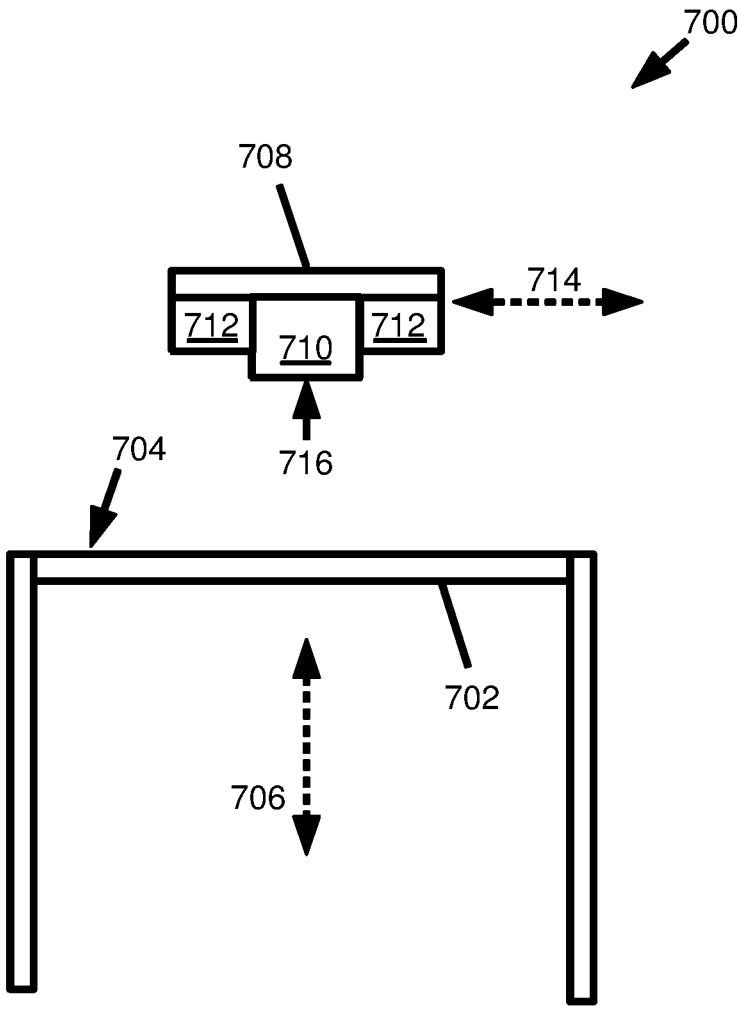
FIG. 7 schematically illustrates some components of an example apparatus for generating a three-dimensional object.

FIG. 7 schematically illustrates some components of an apparatus 700, as an example of a 3-D printer, for generating a three-dimensional object. In this example, apparatus 700 includes a build material support 702 having a build surface 704 corresponding to a build area upon which build layers of build material may be formed. In this example, build material support 702 may move along a build axis 706. In particular, as build layers of build material are formed on build surface 704, build material support 702 may be moved along build axis 706.

Furthermore, in this example, apparatus 700 includes a scanning carriage 708 and a printhead or fluid agent distributor 710 supported by scanning carriage 708. In addition, in this example, energy sources 712 are supported by scanning carriage 708. As such, scanning carriage 708, fluid agent distributor 710, and energy sources 712 may move bi-directionally along a scanning axis 714 over the build area. As an example of a fluid ejection device, fluid agent distributor 710 has a nozzle surface 716 in which a plurality of nozzle or orifices may be formed, similar to that of fluid ejection device 200, 300, 400, 500, 600, as described above.

With such a printer, particles of build material may become airborne in and around the printer, and may settle on and in the printhead including, for example, in nozzles or orifices of the printhead. As such, such particles may be ingested through the nozzles from outside the printhead (as opposed to particles coming from inside the printhead) and may block the nozzles. And, if the particles migrate more upstream, such as into ejection chambers and fluid channels, the particles may block the ejection chambers and/or fluid channels. Thus, nozzle health and/or print quality may be affected, and printhead life may be shortened.

Accordingly, particle tolerant architecture 240, 340, 440, 540, 640, as described above and illustrated in the respective examples of FIGS. 2A and 2B, 3A and 3B, 4A and 4B, 5A and 5B, 6A and 6B, helps to control introduction and ingestion of external particles, such as the described particles of build material, into a printhead. Since the PTA features are recessed relative to the nozzle or orifice, the PTA features are protected from external events such as wiping and other contact (such as printhead crashes). In addition, since the PTA features are recessed relative to the nozzle or orifice, the PTA features have a reduced impact on drop trajectory and ejection dynamics.

Although specific examples have been illustrated and described herein, a variety of alternate and/or equivalent implementations may be substituted for the specific examples illustrated and described without departing from the scope of the present disclosure. This application is intended to cover any adaptations or variations of the specific examples illustrated and described herein.

The invention claimed is:

1. A fluid ejection device, comprising:

a fluid ejection chamber;

a drop ejecting element communicated with the fluid ejection chamber;

an orifice communicated with the fluid ejection chamber;

a fluid passage between the fluid ejection chamber and the orifice; and a structure in the fluid passage between the fluid ejection chamber and the orifice.

2. The fluid ejection device of claim 1, wherein the structure reduces a pass-through area of the fluid passage.

3. The fluid ejection device of claim 1, wherein the structure is recessed relative to the orifice.

4. The fluid ejection device of claim 1, wherein the structure extends from a side of the fluid passage.

5. The fluid ejection device of claim 4, wherein the structure extends across the fluid passage.

6. A fluid ejection device, comprising:

a fluid ejection chamber;

a drop ejecting element communicated with the fluid ejection chamber;

an orifice layer having an orifice formed therethrough communicated with the fluid ejection chamber; and an underlayer having an opening formed therethrough communicated with the fluid ejection chamber and the orifice, wherein the underlayer is disposed between the fluid ejection chamber and the orifice layer, and wherein a pass-through area of the opening is less than a pass-through area of the orifice.

7. The fluid ejection device of claim 6, wherein the orifice layer has a first side and a second side opposite the first side, and wherein the underlayer is disposed on the second side of the orifice layer.

8. The fluid ejection device of claim 6, wherein the underlayer includes an obstruction to form the opening with the pass-through area less than the pass-through area of the orifice.

9. The fluid ejection device of claim 8, wherein the obstruction extends from a side of the opening.

10. The fluid ejection device of claim 8, wherein the obstruction extends across the opening.

11. A fluid ejection device, comprising:

a fluid ejection chamber;

a nozzle fluidically communicated with the fluid ejection chamber;

an ejector element to eject drops of fluid agent from the fluid ejection chamber through the nozzle; and a particle filtering structure upstream of the nozzle to impede particles of build material from entering the fluid ejection chamber though the nozzle.

12. The fluid ejection device of claim 11, wherein the particle filtering structure comprises an obstruction extending into a fluid passage between the fluid ejection chamber and the nozzle.

13. The fluid ejection device of claim 11, wherein the particle filtering structure comprises an obstruction extending across a fluid passage between the fluid ejection chamber and the nozzle.

14. The fluid ejection device of claim 11, wherein the particle filtering structure is recessed relative to the nozzle.

15. The fluid ejection device of claim 11, wherein the nozzle is formed in a nozzle plate and the particle filtering structure is formed in a layer disposed between the nozzle plate and the fluid ejection chamber.

* * * * *